US011518135B2

(12) United States Patent
Schalk

(10) Patent No.: US 11,518,135 B2
(45) Date of Patent: Dec. 6, 2022

(54) APPARATUS AND METHOD FOR THE PRODUCTION OF A CUSHION PRODUCT FROM A SINGLE- OR MULTI-LAYER CONTINUOUS PAPER STRIP

(71) Applicant: Sprick GmbH Bielefelder Papier-und Wellpappenwerke & Co., Bielefeld (DE)

(72) Inventor: Bastian Schalk, Detmold (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 94 days.

(21) Appl. No.: 16/678,861

(22) Filed: Nov. 8, 2019

(65) Prior Publication Data

US 2020/0070461 A1 Mar. 5, 2020

Related U.S. Application Data

(63) Continuation of application No. PCT/EP2018/061884, filed on May 8, 2018.

(30) Foreign Application Priority Data

May 8, 2017 (DE) ..... 102017109842.9

(51) Int. Cl.
*B31D 5/00* (2017.01)
*B26D 1/40* (2006.01)
*B65H 35/04* (2006.01)

(52) U.S. Cl.
CPC ..... *B31D 5/0069* (2013.01); *B26D 1/405* (2013.01); *B65H 35/04* (2013.01);
(Continued)

(58) Field of Classification Search
CPC .... B65H 35/0066; B65H 35/04; B65H 35/08; B65H 2701/191; B65H 2701/1944;
(Continued)

(56) References Cited

U.S. PATENT DOCUMENTS 4,266,276 A * 5/1981 Hayashi ..... B23D 36/0058 318/601
4,525,977 A * 7/1985 Matt ..... B65B 9/067 53/450

(Continued)

FOREIGN PATENT DOCUMENTS

DE 195 36 367 A1 4/1997
DE 694 00 576 T2 4/1997

(Continued)

OTHER PUBLICATIONS

International Search Report and Written Opinion of the International Search Authority dated Aug. 22, 2018 in International Application No. PCT/EP2018/061884 (English and German languages) (14 pp.).

(Continued)

*Primary Examiner* — Thomas M Wittenschlaeger
(74) *Attorney, Agent, or Firm* — Banner & Witcoff Ltd.

(57) ABSTRACT

An apparatus for the production a cushion product from a single- or multi-layer continuous paper strip includes a feed unit for drawing the paper strip into the apparatus, a cutting unit for cutting the cushion product from the paper strip, and control electronics for the activation of the cutting unit according to a predetermined motion profile. A sensor captures a rotation angle position of the feed unit. The control electronics are configured to activate the feed unit continuously and to start an activation of the cutting unit for a discontinuous cutting operation during capturing a predetermined actual rotation angle position of the feed unit.

20 Claims, 15 Drawing Sheets

(52) U.S. Cl.
CPC ..... *B31D 2205/0023* (2013.01); *B31D 2205/0047* (2013.01); *B31D 2205/0058* (2013.01); *B31D 2205/0082* (2013.01); *B31D 2205/0088* (2013.01)

(58) Field of Classification Search
CPC ..... B65H 2557/62; B26D 1/405; B26D 5/20; B26D 5/00; B31D 5/0069; B31D 5/006; B31D 2205/0058; B31D 2205/0064; B31D 2205/0088; B31D 2205/007; B31D 2205/0023; B31D 2205/0047; B31D 2205/0082
See application file for complete search history.

(56) References Cited

U.S. PATENT DOCUMENTS

| | | | | |
|---|---|---|---|---|
| 5,765,460 | A * | 6/1998 | Wathieu | B23D 36/005 83/311 |
| 5,864,484 | A * | 1/1999 | Harding | B31D 5/00 700/127 |
| 5,897,478 | A * | 4/1999 | Harding | B65B 55/20 493/22 |
| 6,168,847 | B1 * | 1/2001 | Murphy | B31D 5/0047 428/128 |
| 6,190,299 | B1 | 2/2001 | Simmons | |
| 6,421,985 | B1 * | 7/2002 | Simmons, Jr. | B31D 5/0047 53/472 |
| 6,632,165 | B1 | 10/2003 | Letourneau et al. | |
| 6,712,253 | B2 * | 3/2004 | Hargrave | B65H 35/10 225/100 |
| 6,918,489 | B2 * | 7/2005 | Harding | B31D 5/0047 206/451 |
| 8,561,978 | B2 * | 10/2013 | Takahashi | B65H 35/04 271/3.01 |
| 9,704,076 | B2 * | 7/2017 | Okushima | G01D 5/34738 |
| 9,884,465 | B2 * | 2/2018 | Sip | B31D 5/0043 |
| 10,926,505 | B2 * | 2/2021 | Bruck | F16M 13/02 |
| 2002/0091053 | A1 * | 7/2002 | Kung | B31F 1/0003 493/350 |
| 2003/0080540 | A1 | 5/2003 | Kinane | |
| 2008/0172986 | A1 * | 7/2008 | Theurer | B65B 57/18 53/284.7 |
| 2009/0004448 | A1 | 1/2009 | Tinianov | |
| 2012/0289392 | A1 * | 11/2012 | Cheich | B31D 5/0047 493/464 |

FOREIGN PATENT DOCUMENTS

| | | | |
|---|---|---|---|
| DE | 697 00 548 | T2 | 4/2000 |
| DE | 101 03 040 | A1 | 11/2001 |
| DE | 697 08 087 | T2 | 8/2002 |
| DE | 694 33 887 | T2 | 7/2005 |
| DE | 698 28 186 | T2 | 12/2005 |
| DE | 10 2012 018 867 | A1 | 3/2014 |
| DE | 10 2012 018 941 | A1 | 3/2014 |
| DE | 10 2012 218 679 | A1 | 4/2014 |
| DE | 10 2013 015 875 | A1 | 3/2015 |
| DE | 10 2014 016 874 | A1 | 5/2016 |
| DE | 10 2016 101 207 | A1 | 8/2016 |
| EP | 0 679 504 | A1 | 11/1995 |
| EP | 0 876 291 | | 11/1998 |
| EP | 1 497 049 | A2 | 1/2005 |
| EP | 1 964 804 | A2 | 9/2008 |
| EP | 2 171 167 | A1 | 4/2010 |
| EP | 2 711 168 | A1 | 3/2014 |
| EP | 2 719 526 | A1 | 4/2014 |
| FR | 2 970 921 | | 8/2012 |
| GB | 2 359 300 | A | 8/2001 |
| GB | 2501260 | A | 10/2013 |
| WO | WO 95/13914 | | 5/1995 |
| WO | WO 97/13097 | | 4/1997 |
| WO | WO 97/27136 | | 7/1997 |
| WO | WO 97/43097 | | 11/1997 |
| WO | WO 99/17923 | | 4/1999 |
| WO | WO 00/21723 | | 4/2000 |
| WO | WO 03/089163 | A2 | 10/2003 |
| WO | WO 2015/039756 | A1 | 3/2015 |
| WO | WO 2016/037764 | A1 | 3/2016 |
| WO | WO 2016/075001 | A1 | 5/2016 |
| WO | WO 2017/165321 | A1 | 9/2017 |
| WO | WO 2018/005902 | A1 | 1/2018 |

OTHER PUBLICATIONS

International Search Report and Written Opinion of the International Search Authority dated Jul. 20, 2018 in International Application No. PCT/EP2018/061848 (English and German languages) (10 pp.).
International Search Report and Written Opinion of the International Search Authority dated Jul. 20, 2018 in International Application No. PCT/EP2018/061860 (English and German languages) (10 pp.).
International Search Report and Written Opinion of the International Search Authority dated Jul. 20, 2018 in International Application No. PCT/EP2018/061685 (English and German languages) (10 pp.).
Office Action dated Feb. 8, 2018 for German Patent Application No. 10 2017 109 829.1, (10 pp.).
Office Action dated Dec. 12, 2017 for German Patent Application No. 10 2017 109 867.4, (10 pp.).
Office Action dated Dec. 5, 2017 for German Patent Application No. 10 2017 109 851.8, (10 pp.).
Office Action dated Nov. 28, 2017 for German Patent Application No. 10 2017 109 842.9, (10 pp.).

* cited by examiner

APPARATUS AND METHOD FOR THE PRODUCTION OF A CUSHION PRODUCT FROM A SINGLE- OR MULTI-LAYER CONTINUOUS PAPER STRIP

PRIORITY

This application is a continuation application of International PCT Patent Application No. PCT/EP2018/061884 filed on May 8, 2018, entitled "DEVICE AND METHOD FOR PRODUCING A PADDING CUSHION FROM A SINGLE-LAYER OR MULTIPLE-LAYER CONTINUOUS PAPER WEB," which claims priority to German Patent Application No. 10 2017 109 842.9 filed on May 8, 2017, the entire contents of both of which are incorporated herein by reference.

TECHNICAL FIELD

The invention generally relates to an apparatus for the production of a cushion product from a single- or multi-layer continuous paper strip as well as a respective production process.

BACKGROUND

A cushion product production apparatus according to the subject is known from DE 20 2012 018 867 A1. The known apparatus draws in the paper strip by a driven fixation and/or deformation station, which has two embossing wheels engaging with each other, which further deform a tubular preformed paper strip and provided with a wave-shaped imprint profile. Subsequently, individual cushion products are cut-off from the deformed paper strip by a rotation cutter. The cut-off cushion products are then ejected and can be used by the packing personal as cushion material. The feed drive of the embossing wheel as well as the drive of the rotation cutter is coordinated to each other in such a way that the feed movement of the paper strip and the rotation movement of the blade are each executed uninterruptedly continuously. For this purpose, a velocity sensor should be provided at both, the deformation station and the cutting station.

A different cushion product production apparatus according to the subject is known from DE 10 2014 016 874 A1. This production apparatus has a rotation blade, which, by means of a conveyor having embossing the feed wheels, is being supplied with a formed paper strip. The rotation cutter cuts off individual cushion products from the deformed paper strip. The cushion products are ejected from the production apparatus by a discharger with the second wheel work, which has feed wheels. The conveyor, the discharging unit and the rotation blade of the production apparatus according to DE 10 2014 016 874 A1 are coordinated in such a way that the edge of the paper strip preceding in feed direction is getting engaged with the discharging unit before or latest when the rotation blade cuts off a cushion product from the paper strip. The synchronized operation of conveyor, discharger and rotation blade is provided by a sensor system or time control.

The known cushion product production apparatuses are suited for the fabrication of large amounts of cushion products in short time so that they are suited for the logistic facilities with high throughput. They distinguish oneself particularly by a low failure rate, since they minimize the risk of paper jam. Nevertheless, there is a desire for a more cost-effective alternative compared to the known apparatuses, which comply with the same high technical requirements to the production volume and paper jam avoidance.

SUMMARY

Dunnage material production apparatuses are for example placed in logistic centers as non-stationary, mobile units in order to provide length-wise tailored cushion products during packaging of items. The cushion products are obtained from a paper strip roll, particularly a recycling paper strip roll or Kraft paper strip roll, or from a paper strip that is stacked Leporello-like that are comparably space-saving, compared to the cushion products. For the production of the cushion product, the paper strip is stripped from a supply roll or supply stack and formed in such a way that air pockets are formed that provide a damping between the articles to be shipped and the shipping container.

It is an objective to overcome the disadvantages of the prior art and particularly to provide an inexpensive apparatus for the production of a cushion product from a single- or multi-layer continuous paper strip. Accordingly, a further apparatus for the production of a cushion product from a single- or multi-layer continuous paper strip is described as one embodiment. The production apparatus according to one embodiment comprises a feed unit for drawing in the paper strip into the apparatus. Preferably, the feed unit comprises at least one feed roller, particularly two feed rollers, which can be realized particularly as feed and forming rollers for example with teeth wheel-like profile. The feed unit preferably comprises a (first) motor, like an electro motor, for example a direct current motor. The feed unit can have one or several shafts as well as a reduction gear, if applicable. The motor is preferably coupled to a gearing mechanism, which drives at least one roller of the feed unit with a reduced drive rotation velocity compared to the motor rotation velocity. If the feed unit has two or more rollers, a second or a further roller can be driven directly by the motor or indirectly by the first, driven roller. At a feed unit with a pair of rollers having two rollers with teeth wheel-like profile engaging with each other, a side plate or two side plates opposing each other can be aligned at an axial edge of the roller, particularly an axial edge of the teeth wheel profiling. By drawing in the paper strip in the production apparatus, a feed direction is defined.

The apparatus according to one embodiment for producing a cushion product comprises a cutting unit for cutting the cushion product from the paper strip, particularly from the tubular-shaped paper strip. It shall be clear that the paper strip is formed to a three-dimensional fill material strand upstream in feed direction of the cutting unit of the cushion product production apparatus, for example by a feeding chute and/or by forming and/or feeding rollers. The cutting unit is preferably provided for cutting the cushion product and predetermined cushion product length.

The production apparatus according to one embodiment comprises a control electronics for activating the cutting unit according to a predefined motion profile, particularly a velocity profile and/or a torque profile. The predefined motion profile defines a motion repeating itself for each cutting process. The cutting unit can for example have a rotation blade executing, according to the predefined motion profile, a revolution, particularly by 360°, according to a predefined velocity, acceleration and/or torque profile. The cutting unit separates the cushion product from the paper strip during the sequence of the predefined motion profile. The control electronics has a sensor for capturing a rotation angle position of the feed unit.

According to one embodiment, the control electronics is designed or set up, respectively, to start an activation of the cutting unit for a discontinuous cutting operation during capturing of a predefined actual rotation angle position. The control electronics activates the cutting unit for each cutting process preferably individually or/and, if applicable, triggers a cyclic motion of the cutting unit, during which a cutting tool of the cutting unit, preferably a rotation blade, runs along a cyclic motion path, for example up and down, in circle or suchlike, wherein the cutting tool is moving starting from an initial position to a cutting position and subsequently returns from the cutting position to the initial position. The cutting tool stops at the initial position. The control electronics is preferably set up to start a cyclic cutting process, for example a revolution of the rotation blade by 360°, when the sensor for capturing the rotation angle position of the feed assembly is capturing a predefined actual rotation angle position of the feed unit. The control electronics can be set up to start the discontinuous cutting operation when reaching or when exceeding the predefined actual rotation angle position.

It was surprisingly found out that cushion products of predefined length with a narrow tolerance band of +/−5 cm of length or even +/−1 cm of length are reproducible and fabricatable in high quantities also without a complicated closed loop control of the feed unit and cutting unit of the cushion product production apparatus. In particular, it was surprisingly found out that for a save, fast, reproducible fabrication of cushion products it is not necessarily required to capture the feed rate of the paper strip by a sensor or to coordinate the revolution velocities of the feed rollers and the rotation blade by a closed loop control. Since the production apparatus according to one embodiment does not need complicated closed loop control electronics, it can be realized more cost efficient and still assure nearly the same, high quality cushion product quantity and quality as the known cushion product production apparatuses.

According to one embodiment of the apparatus, the control electronics is set up to determine, particularly to define and/or to capture and/or to save, a target feed rate for drawing in the paper strip and for activating the feed unit particularly continuously according to the target feed rate. Furthermore, the control electronics according to this preferred embodiment is set up to determine, particularly to define and/or to capture and/or to save, a target cushion length and to set the cutting operation according to the target feed rate and/or the target cushion length. For example, a discontinuous cutting operation at a constant feed rate (for example 3 m/s) can be realized, that cushion products of desired length (for example 30 cm) are produced, as the control electronics triggers virtually a clocked cutting operation (in this case about every 1/10 seconds). The velocity of the feed unit, for example the revolution velocity of the feed rollers, during a continuous draw-in of the paper strip is respectively constant, so that a rotation angle position of the feed rollers, of the feed roller drive, of a eventually present gearing mechanism between feed roller drive and feed rollers and/or a roller shaft are captured with the sensor, representing the desired cutting clock. Particularly, the control electronics is set up to consider a feed diameter of the feed unit and/or a cutting diameter of the cutting unit. For example, precisely one cutting process per full revolution of the feed rollers can be provided in a feed unit with a pair of feed rollers or such with a specific feed diameter (for example 10 cm) and a predefined target cushion product length (for example 31 cm). Besides, the control electronics can trigger a cutting process when capturing precisely one revolution of the feed roller by 360°. If a cushion product of 62 cm length is desired, the control electronics can activate a pair of feed roller with the diameter of 10 cm and can trigger a cutting process on each revolution by 720°. If a shorter pillow of for example about 20 cm of length is desired, a cutting process can be triggered by the control electronics after a revolution by 240° of a feed roller with a diameter of 10 cm. The sensor can preferably be arranged at a gearing mechanism exit shaft, a motor exit shaft, a conveyor (feed roller) bearing shaft.

According to one embodiment, the sensor comprises a particularly ferromagnetic or permanent magnetic incremental encoder and/or a preferably electromagnetic incremental receiver. The incremental encoder preferably has an incremental resolution between 20 and 100 increments/360°, preferably 30-60 increments/360°, particularly preferred 40 increments/360°. An incremental encoder can for example be realized as a ferromagnetic incremental encoder with teeth wheel profile, wherein the teeth of the incremental encoder can be rectangular or, preferably narrowing, for example be triangular in cross action. It was surprisingly found out that an incremental encoder with less than 50 increments per 360°, preferably with narrowing cross section shape of the increments, in combination with a particularly low-priced optical or electromagnetic sensor can still provide a high accuracy of the measurement in order to securely assure a precise reproducibility of a desired cushion product length. The incremental encoder is aligned turnably fixedly at a rotating component of the feed assembly.

According to one embodiment of the cushion product production apparatus according to the invention, the controller electronics is set up to define the predetermined actual rotation angle position for the cutting operation for producing cushion products according to a target pillow length on the basis of the target feed rate particularly in consideration of the feed diameter and/or the cutting diameter, a predefined rotation angle position of 30° for example triggers twelve cutting processes per revolution. A predefined actual rotation angle position of 450° triggers a cutting process every 1.5 revolutions. The control electronics can make an assignment for a target cushion length at a predefined target feed rate set at the production apparatus, using experience values or using calibration values for example captured during an initialization or start-up of the cushion product production apparatus, of a desired target cushion product length taking in consideration of a set target feed rate regarding a predefined rotation angle position.

Reaching or exceeding the incremental count threshold value can be determined by the control electronics, for example by a counter counting up until an incremental count threshold value is reached and the count is set to 0 when reaching or exceeding the implemental count value. It is also thinkable that the control electronics repeatedly counts down to 1 or 0, starting from a specific incremental count value. Alternatively, a counter of the control electronics can count continuously and trigger a cutting process when reaching or exceeding each multiple of the incremental count threshold value. Other capturing processes are thinakable.

The control electronics is particularly set up to determine an incremental count threshold value particularly in consideration of the feed diameter and to trigger an activation of the cutting unit when the sensor is capturing, preferably reaching or exceeding, the incremental count threshold value. It shall be clear that the number of increments with equal distribution of the increments defines an incremental resolution, for example 20, 30, 40, 60, or 100 increments per 360°, when a sensor with incremental encoder is used, wherein each increment correlates to an angle step, so that each increment is assignable to a rotation angle position.

According to one embodiment of a cushion product production apparatus according to one embodiment, the control electronics is set up to a control the feed unit and the cutting unit to another in such a way that the cutting rate, particularly a circumferential velocity with a rotation blade, is as large as or slightly, particularly 100% to 10%, preferably 5%, higher than the circumferential velocity of the feed unit at the feed parameter corresponding to feed diameter, relating to the cutting position, in which a cutting tool of the cutting unit is cutting the paper strip for cutting the cushion product. The circumferential velocity of the feed unit preferably equals the feed rate of the paper strip. By a slightly higher cutting rate in relation to the production apparatus circumferential velocity or the feed rate, respectively, a secure and clean cutting of the cushion product from the paper strip can be provided.

According to one embodiment, the cutting unit comprises a rotation blade and the control electronics a (second) sensor assembly for capturing a rotation angle position of the cutting unit, particularly of the rotation blade shaft. A cutting unit with rotation blade has preferably a rotation cutting pad, which is arranged opposing the rotation blade and rotates adaptably to the rotation velocity of the rotation blade in order to provide a counter bearing to the rotation blade for the cutting engagement. The blade of the rotation cutter is positioned transversely to the feed direction of the paper strip. The blade of the rotation cutter extends in transverse direction of the paper strip and/or perpendicular to the length direction of the paper strip. The rotation blade particularly extends linearly. The blade is positioned preferably parallel to the rotation axis or, respectively, the rotation blade shaft of the rotation cutter and rotates on a cylinder shape orbit. The feed path of the paper strip crosses the orbit of the blade preferably essentially in a tangential or slightly secant-fashion, so that the cushion product is cut off from the paper strip with one cutting stroke and the passing engagement point of the blade at the tangential position or in the area of the secant. The length of the blade preferably at least equals the width of the feed path. The rotation blade can, preferably with a cutting pad, define a cutting diameter of the cutting unit. The cutting unit preferably has a (second) motor, preferably an electromotor, particularly a direct current motor. It shall be clear that the cutting unit can have a motor different from the feed unit. The cutting unit can have one or several embossing tools in order to fixate the following-up end of the cushion product by an imprint and/or to fixate the preceding end of the paper strip or the next pillow particularly by an imprint, respectively. The rotation blade and/or an eventually present rotation cutting pad can be coupled to the motor by at least one shaft and/or one gearing mechanism, particularly a reduction gear. The parts, on which the rotation blade is arranged rotatably fixedly, and the cutting pad shaft, on which a cutting pad is arranged turnably fixedly, are preferably kinematicly connected by coupling, for example by a teeth wheel coupling, particularly play-free, in order to provide a synchronous operation of the rotation blade and the cutting pad.

In particular, the sensor assembly has a second, particularly ferromagnetic or magnetic implemental encoder as well as a second preferably electromagnetic implemental receiver. The second incremental encoder preferably has an incremental resolution between 10 and 100 increments/360°, preferably 15 to 60 increments/360°, particularly preferred 20 increments/360°. It was shown that for a sufficient capturing accuracy regarding the rotation angle position of the cutting unit, a lower, particularly about half, resolution is sufficient compared to the resolution of the sensor of the feed unit.

According to one embodiment, the sensor assembly is set up to capture a cut rotation angle position or cutting position, respectively, and/or a hold point rotation angle position or, respectively, initial or reference position of the rotation plate. The sensor assembly is preferably set up to capture this/these specific rotation angle position(s) with only one (or only two) position encoder(s). The control electronics is particularly set up to initiate a breaking process for the cutting unit when capturing the cut rotation angle position.

Another embodiment relates to a method for the machine-made production of a cushion product from a single- or multi-layer continuous paper strip. The method involves that a feed unit for drawing in the paper strip into the unit is operated continuously. In particular, the feed unit for drawing in the paper strip is operated with constant feed rate. The method according to one embodiment further involves that the cutting unit is operated discontinuously for cutting the cushion product from the paper strip according to a predefined motion profile, particularly a velocity-acceleration and/or torque profile. It shall be clear that the cutting unit for the cutting of the cushion product from the paper strip can be operated in a formed paper strip state. The paper strip is particularly formed before entering the cutting unit, in a three-dimensional dunnage material strand. The method according to one embodiment further involves that a rotation angle position of the feed unit is captured by a sensor assembly, like an incremental sensor unit. According to one embodiment, the discontinuous cutting related to the production method is triggered when reaching a predefined actual rotation angle position of the feed unit. The discontinuous cutting can for example be realized by a cutting unit realized as rotation cutter by a single revolution of its rotation blade. Before and after the discontinuous cutting process, the rotation blade preferably stands still.

In one embodiment for the production of the cushion product from a single- or multi-layer continuous paper strip, the predefined motion profile comprises an acceleration phase, in which a cutting tool, preferably a rotation blade, preferably of a cutting unit, is accelerated to a nominal speed. The predefined motion profile further comprises a running phase, in which the cutting tool is moved preferably constant with nominal velocity, wherein particularly the nominal velocity is as high or slightly, particularly 1% to 10%, preferably 5%, higher than the feed rate. The predefined motion profile further comprises a cutting process, during which the cutting unit is separating the cushion product from the paper strip, which can for example be formed tubular. In doing so, the cutting rate or the cutting tool can be as high as, or slightly, particularly 1% to 10%, preferably 5%, higher than the feed rate. The predefined profile further comprises a breaking phase, in which the velocity of the cutting unit is reduced. Finally, the predefined motion profile comprises a holding phase, in which the cutting tool is held stationarily, preferably in an initial position or reference position, respectively, or holding point rotation angle position. The method according to one embodiment can take place according to the functionality of the apparatus described above. The production apparatus according to one embodiment can act according to the production method.

BRIEF DESCRIPTION OF THE DRAWINGS

The system and method may be better understood with reference to the following drawings and description. Nonlimiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

DETAILED DESCRIPTION

Figure 1A:
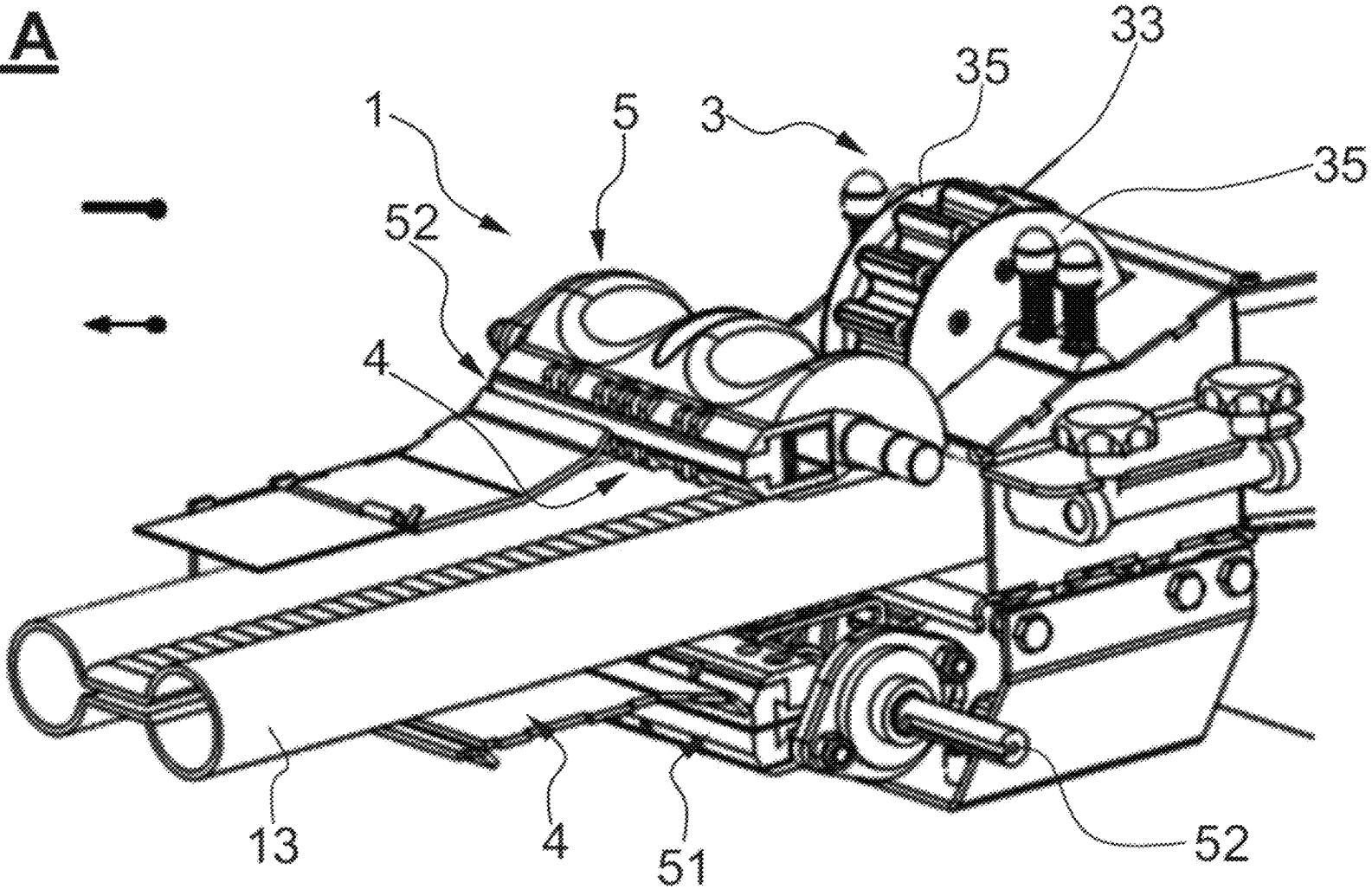
FIGS. 1A-1F are a perspective, partly sectioned view of an apparatus according to one embodiment for the production of a cushion product, wherein the cutting unit is in different rotation angle positions.

The apparatus according to one embodiment for the production of a cushion product from a single- or multi-layer continuous paper strip is attributed in the figures with the reference numeral 1. The continuous paper strip has the reference numeral 13 and the cut-off cushion product has the reference numeral 11. The apparatus 1 exhibits main components of a feed unit 3 for drawing in the paper strip 13, a cutting unit 5 for cutting off the cushion product 11 from the paper strip 13 and control electronics 21 for initializing the cutting unit.

Figure 2A:
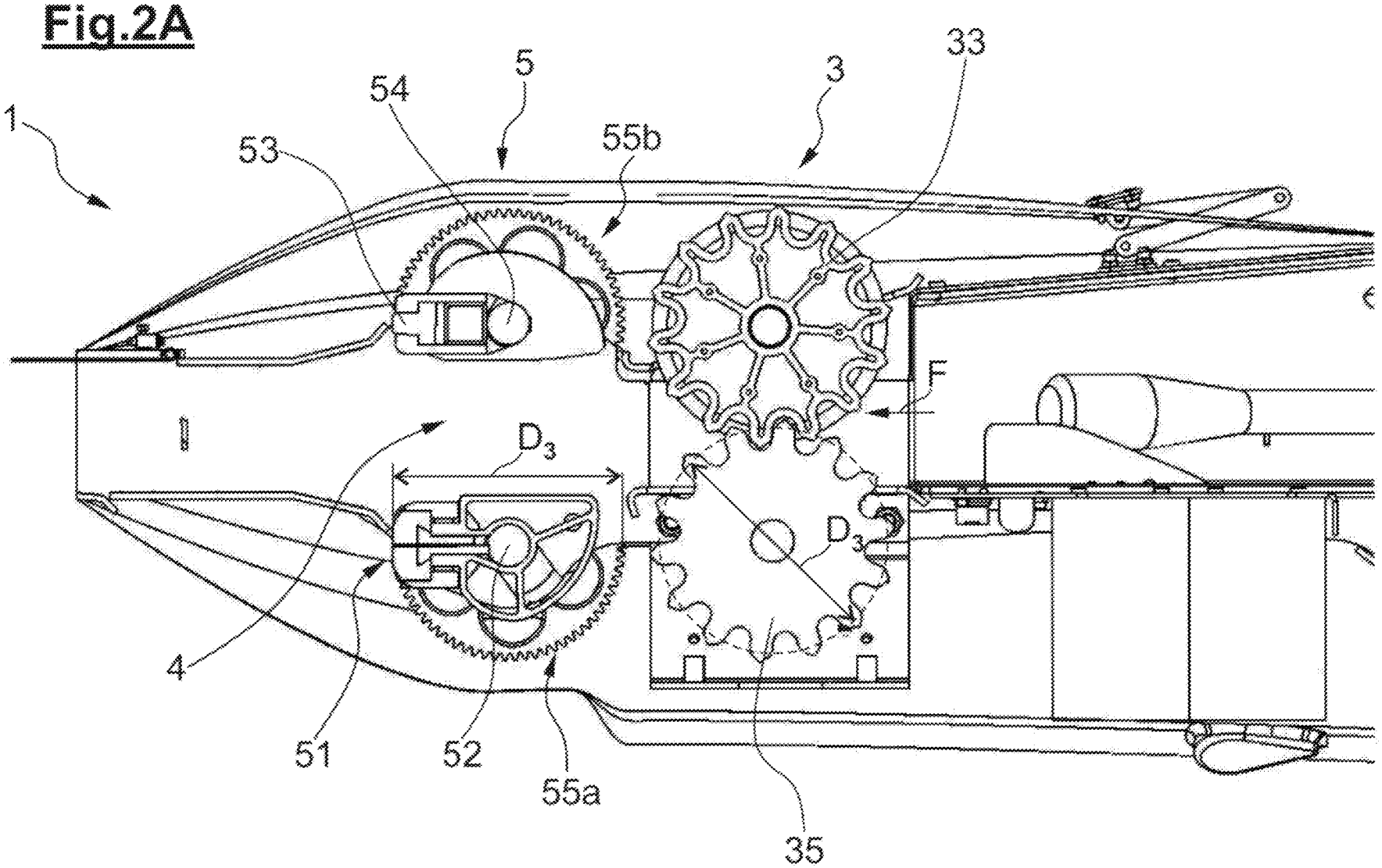
FIGS. 2A and 2E are lateral cross section views of the apparatus according to one embodiment according FIGS. 1A and 1E.
Figure 2E:
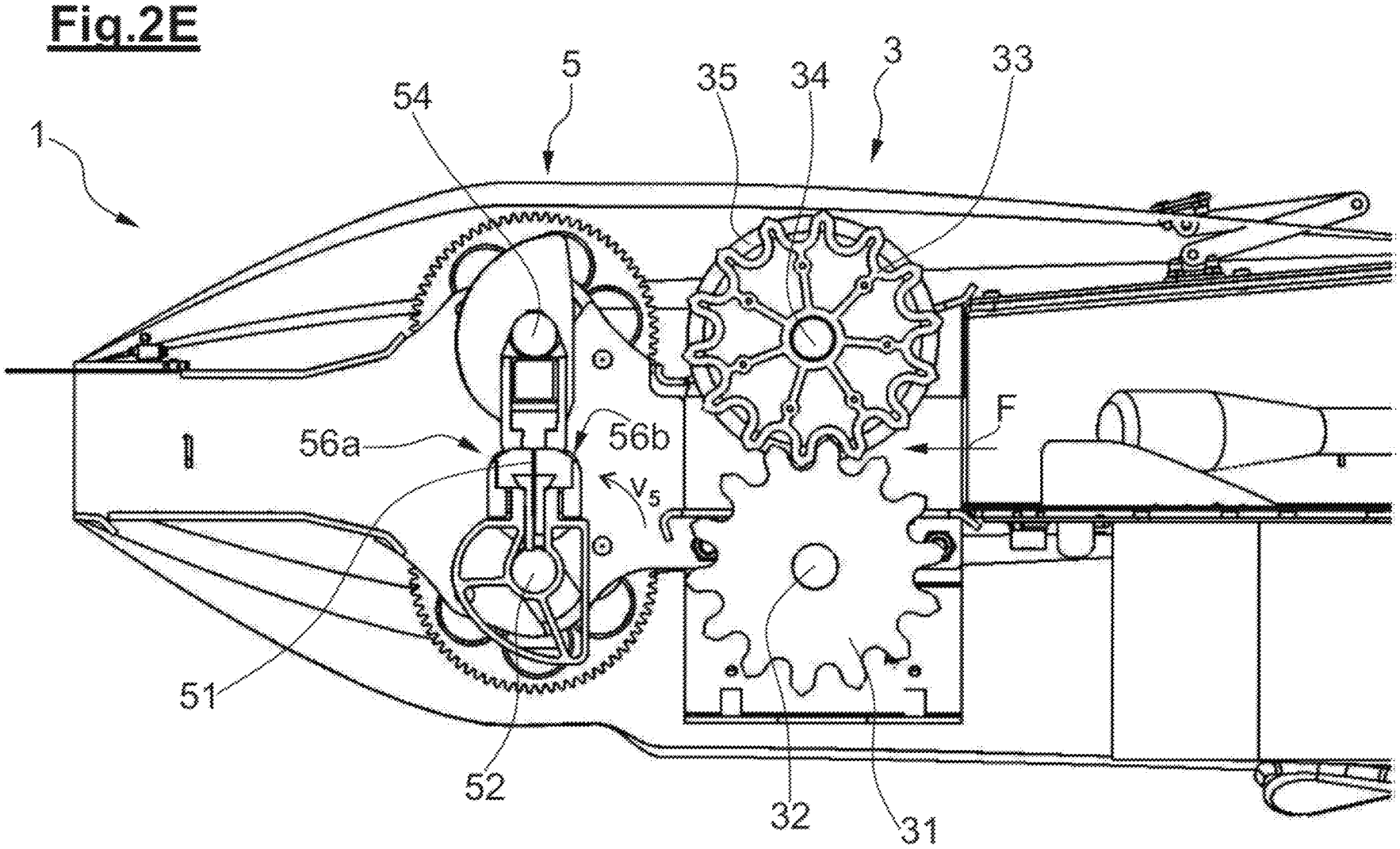

The feed unit 3 comprises a pair of feed and embossing rollers 31, 33. The embossing rollers 31, 33 of the feed unit 3 each exhibit a teeth profile and comb each other. The lower embossing roller 31 is stationarily mounted to the feed roller shaft 32. The feed roller shaft 32 is driven by an electromotor 41, which is preferably realized as direct current motor. The drive rotation speed of the motor 41 is reduced by a reduction gear 43 into a lower rotation velocity of the feed roller shaft (32). The upper feed roller 33 is held stationarily at the feed roller shaft 34 and rotates with it by the combing engagement with the first, driven, feed roller 31. The feed roller 33 is connected rotationably with a side plate 35, whose plate diameter essentially equals the outer teeth diameter. The imprint of the feed and forming rollers 31, 33 is wave-shaped. The side plates 35 stabilize the wave-shaped imprint in transverse direction. The combing engagement of the lower feed roller 31 in the upper feed roller 33 defines a feed diameter D3 which equals the identical pitch circle diameter of the feed rollers 31, 33, of the defected preferred embodiment (FIG. 2A, FIG. 2E).

Figure 3:
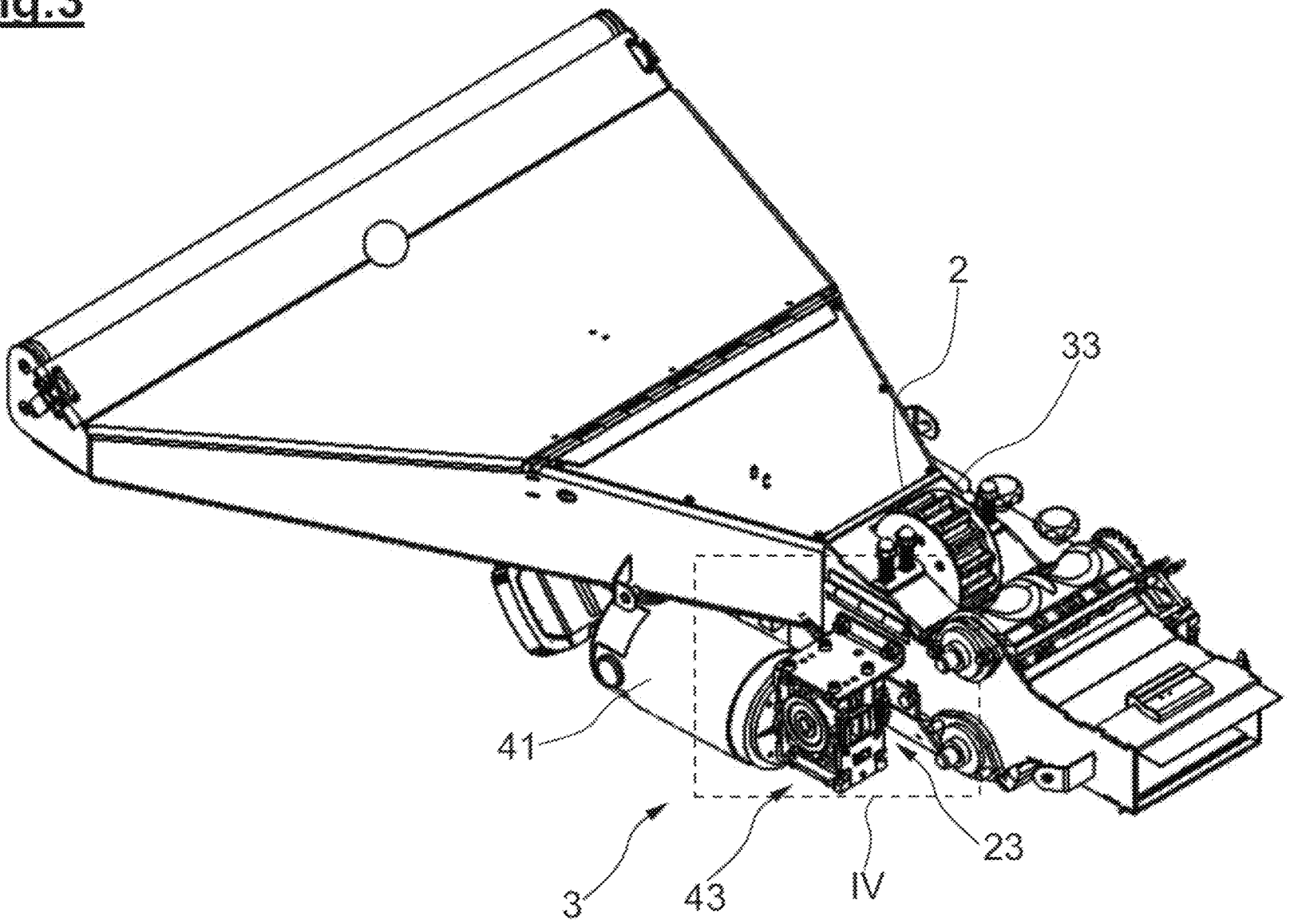
FIG. 3 is a perspective view of an apparatus according to one embodiment according to FIG. 1.
Figure 4:
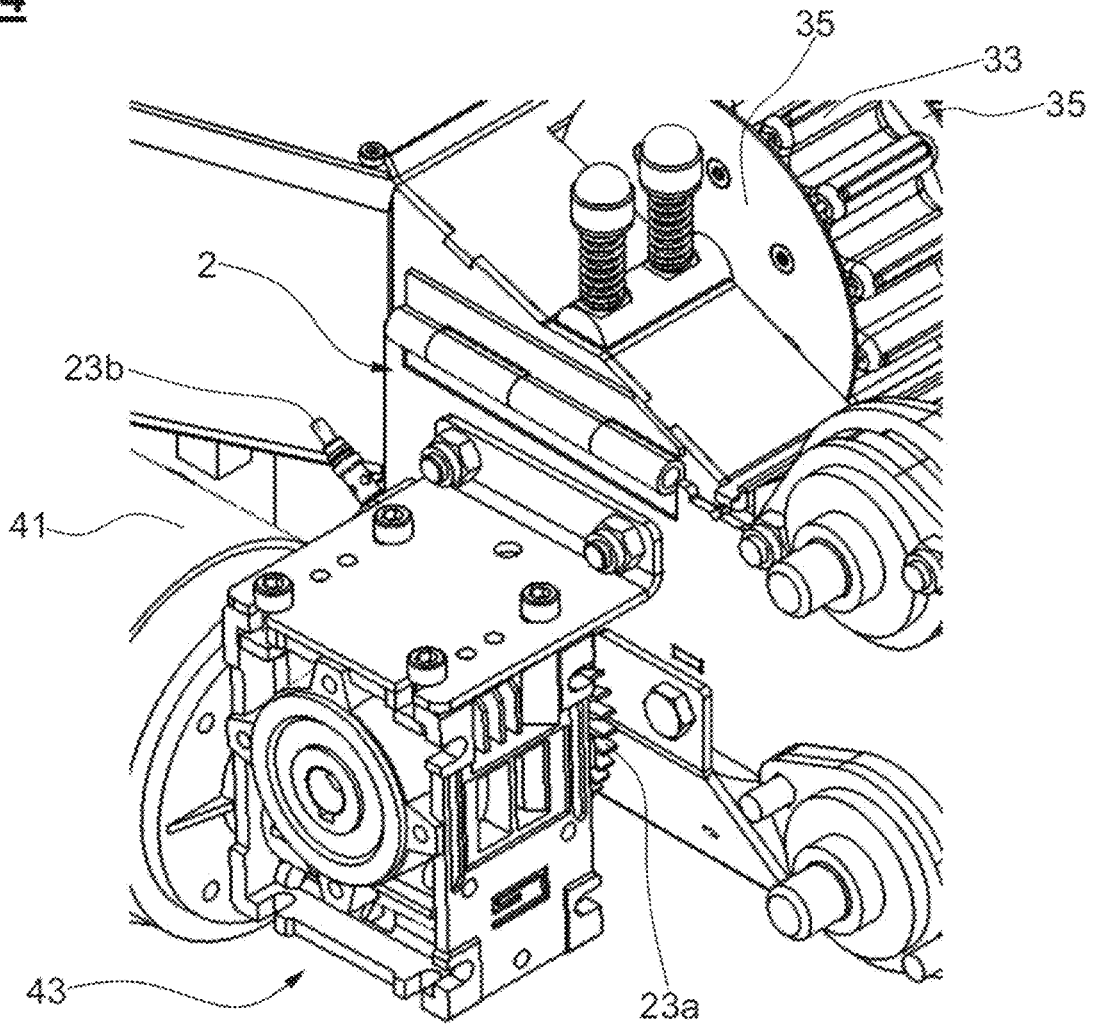
FIG. 4 is a detail view according to the detail IV of FIG. 3.

As shown in FIGS. 3 and 4, an incremental encoder 23*a* is aligned at the lower feed roller shaft 32 non-rotatably. The incremental encoder 23*a* comprises 40 increments, which narrow and are distributed evenly over the perimeter of the incremental encoder 23*a*. An incremental receiver 23*b* for capturing the increments or the incremental encoder 23*a* or the rotation angle position of the lower feed roller shaft 32 or the initial shaft of the gear 43, respectively, is aligned stationarily at a frame 2 of the apparatus 1. The incremental encoder 23 can be milled or cut, particularly laser cut, from a ferromagnetic sheet metal.

The preferred embodiment of a cutting unit 5 depicted in the figures is realized as rotation cutter. The rotation cutter comprises a rotation blade 51 as well as a cutting pad 53 cooperating with the blade 51. The rotation blade 51 is held non-rotatably at the cutting shaft. The cutting pad 53 is held non-rotatably at a cutting pad shaft 54. The rotation movement of the cutting shaft 52 and the pad shaft 54 is synchronized by a pair of teeth wheels 55*a*, 55*b*.

Figure 5:
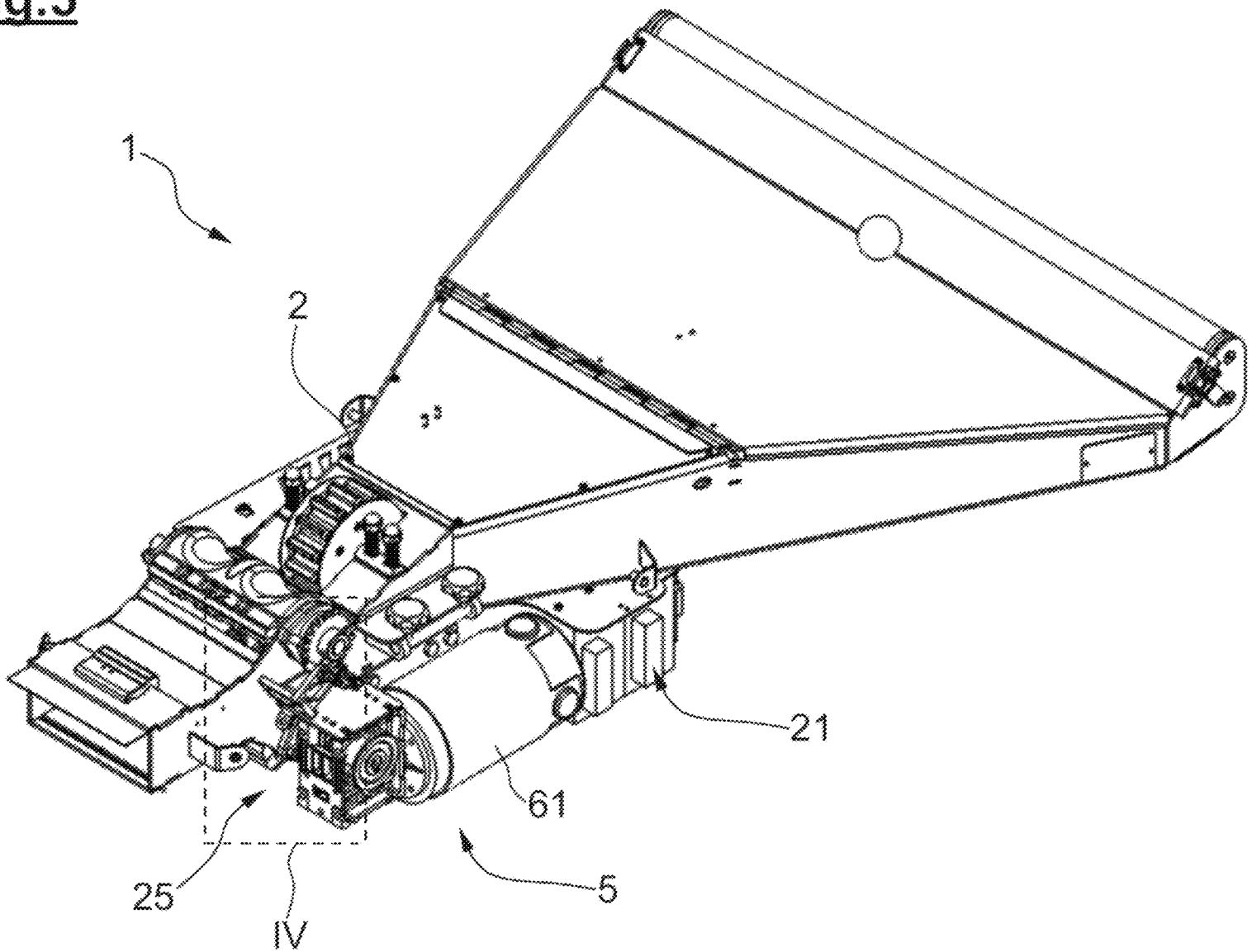
FIG. 5 is a different perspective view of the cushion product production apparatus according to FIG. 1.
Figure 6:
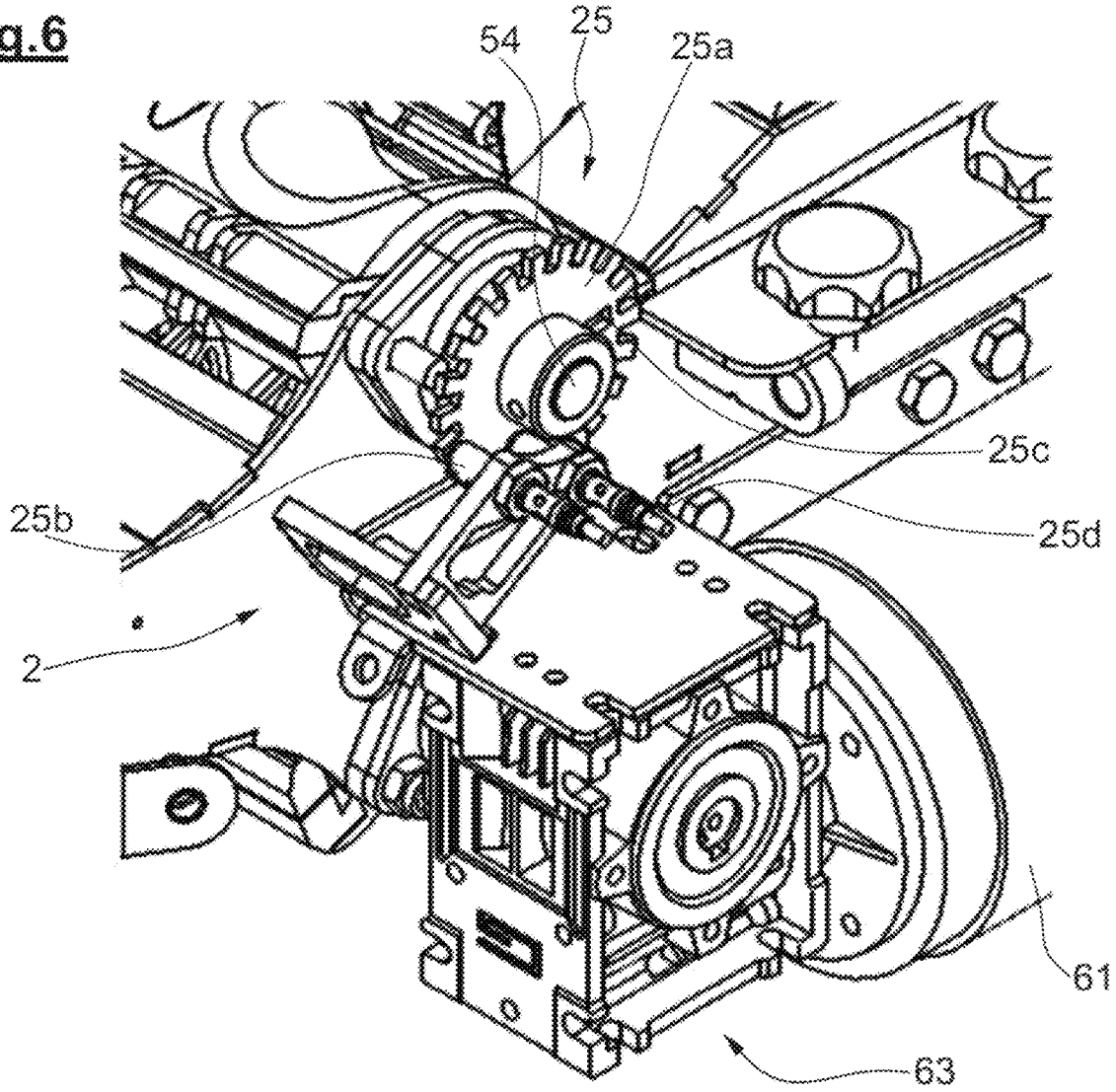
FIG. 6 is a detail view according to the detail VI according to FIG. 5.
Figure 7:
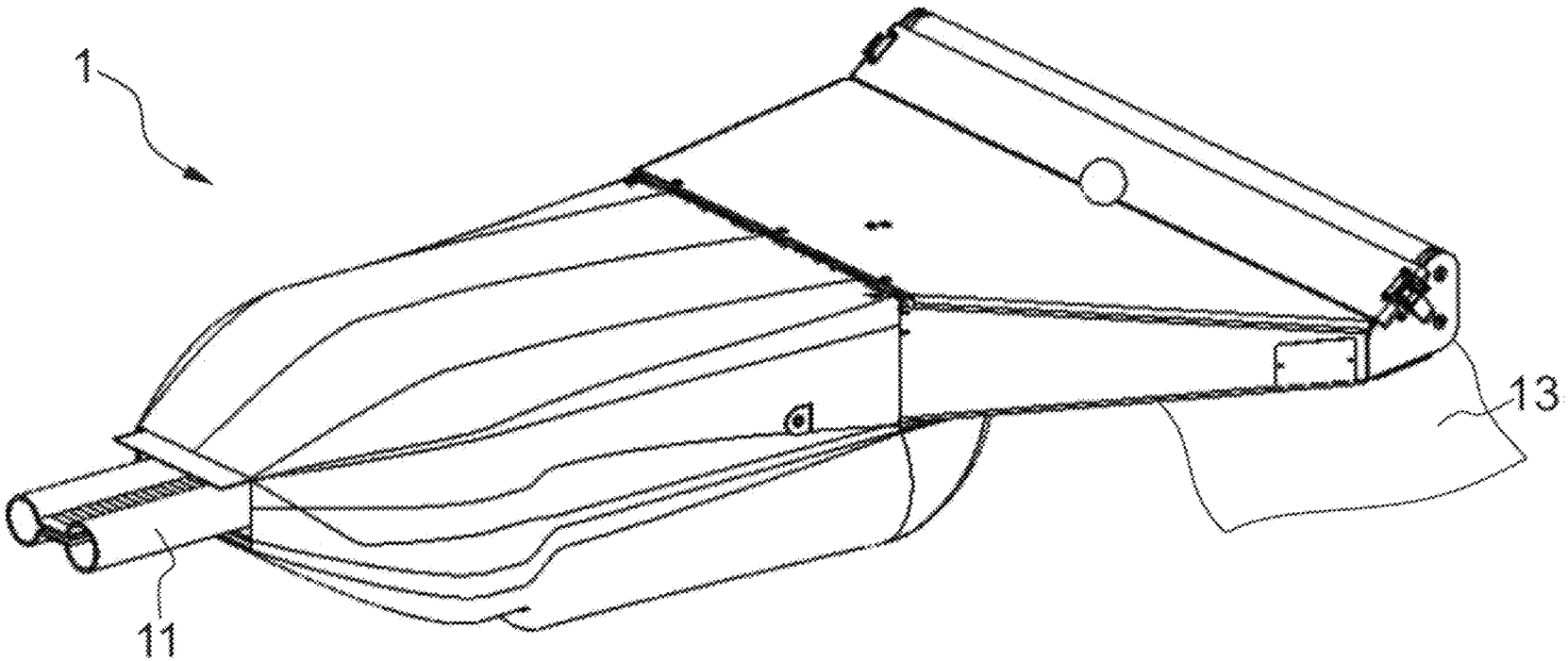
FIG. 7 is a perspective depiction of a cushion product production apparatus according to one embodiment according to FIGS. 1A-1F.

The cutting unit 5 of the preferred embodiment of a paper pillow production apparatus 1 shown in FIGS. 5 and 6 exhibits an electric drive motor 61, preferably a direct current motor, as well as a reduction gear 63 for providing a reduced cutting shaft rotation speed, compared to the rotation velocity of the electromotor 61. The electromotor 61 of the cutting unit 5 and the electro motor 41 of the feed unit 3 can be constructed identically. The gear 63 of the cutting unit 5 and the gear 43 of the feed unit 3 can be constructed identically. The incremental encoder 25*a* of the sensor assembly 55 of the cushion product production apparatus according to one embodiment shown in FIG. 6 is arranged at the cutting pad shaft 54 non-rotatably. The incremental receiver 25*b*, which cooperates with the incremental encoder 25*a*, is aligned at the frame 2 of the apparatus 1 stationarily. The increments of the incremental encoder 25*a* have a rectangular-shaped cross section shape and their number is 20. The sensor assembly 25 also has a position encoder 25*c*, which is provided according to a cutting blade initial position A or initial position, wherein the arrival of this initial position A can be captured by the position receiver 25*d*, which is mounted at the frame 2 stationarily.

The sensor 23 and the sensor assembly 25 are connected with the control electronics signal transmission correspondingly. The incremental receiver 23*b* and 25*b* are preferably constructed identically. The position receiver 25 and the incremental receiver 25*b* and/or 23*b* can also be realized constructively identically. By the disposition of similar components, cost reductions can be achieved.

Figure 9:
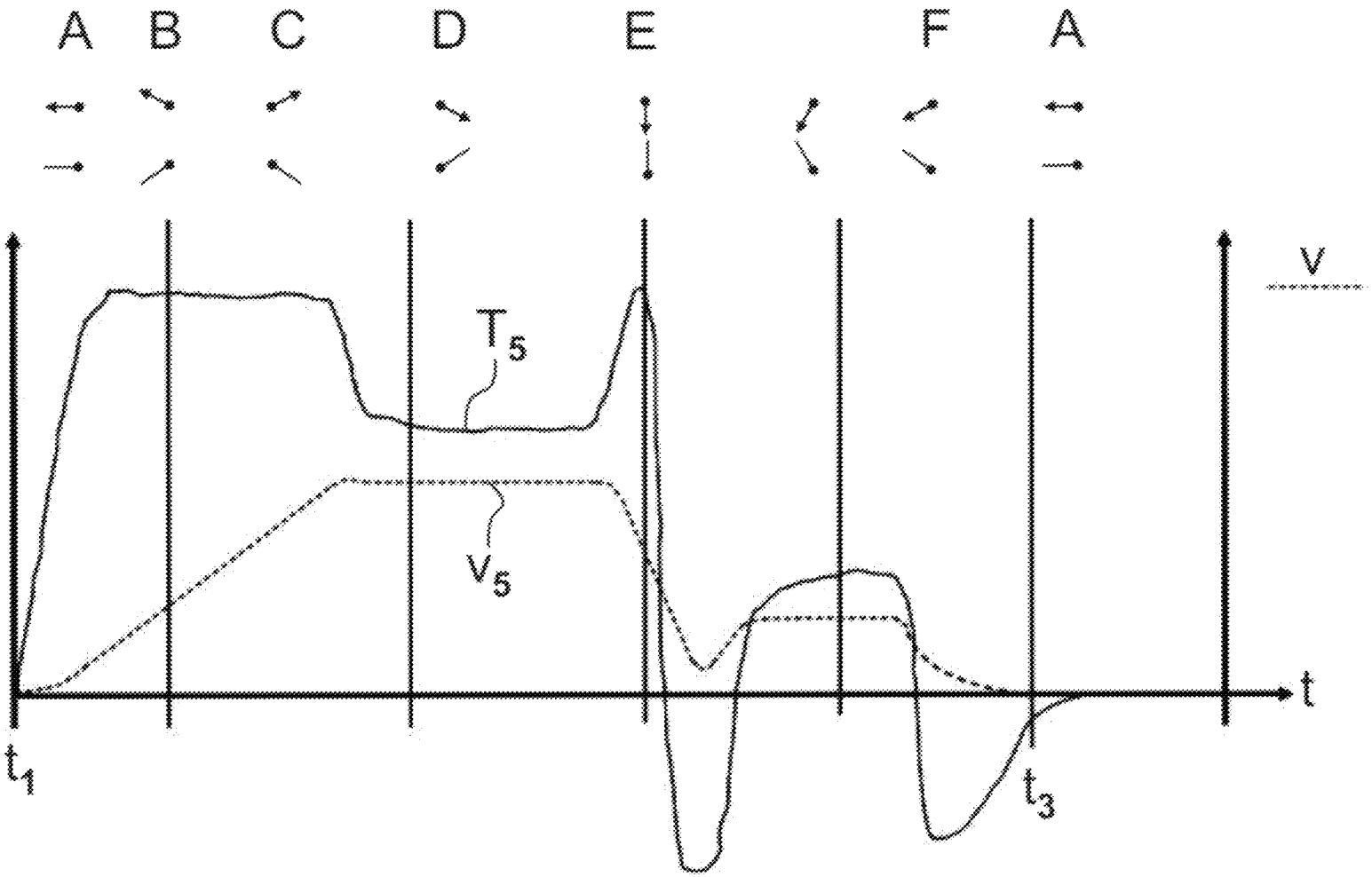
FIG. 9 is a depiction of a predefined velocity and a predefined torque profile for the operation of the cutting unit.

FIGS. 1A (and 2A), 1B, 1C, 1D, 1E (and 2E) as well as 1F show different rotation angle positions of the cutting unit 5 and of the feed unit 3. The perspective rotation angle positions A-F are shown in the diagram of a motion profile, that is a velocity profile v5 or, respectively, a torque profile T5, shown in FIG. 9.

FIGS. 1A and 2A show the production apparatus 1 in perspective or in side view, respectively, in a state, in which the rotation cutter largely clears a feed channel 4 for letting pass a formed paper strip 13 so that the paper strip 13 can pass the cutting unit 5 basically unhindered.

The initial position A shown in FIGS. 1A and 2A of the rotation cutter can be captured by the sensor assembly 25.

Figure 1B:
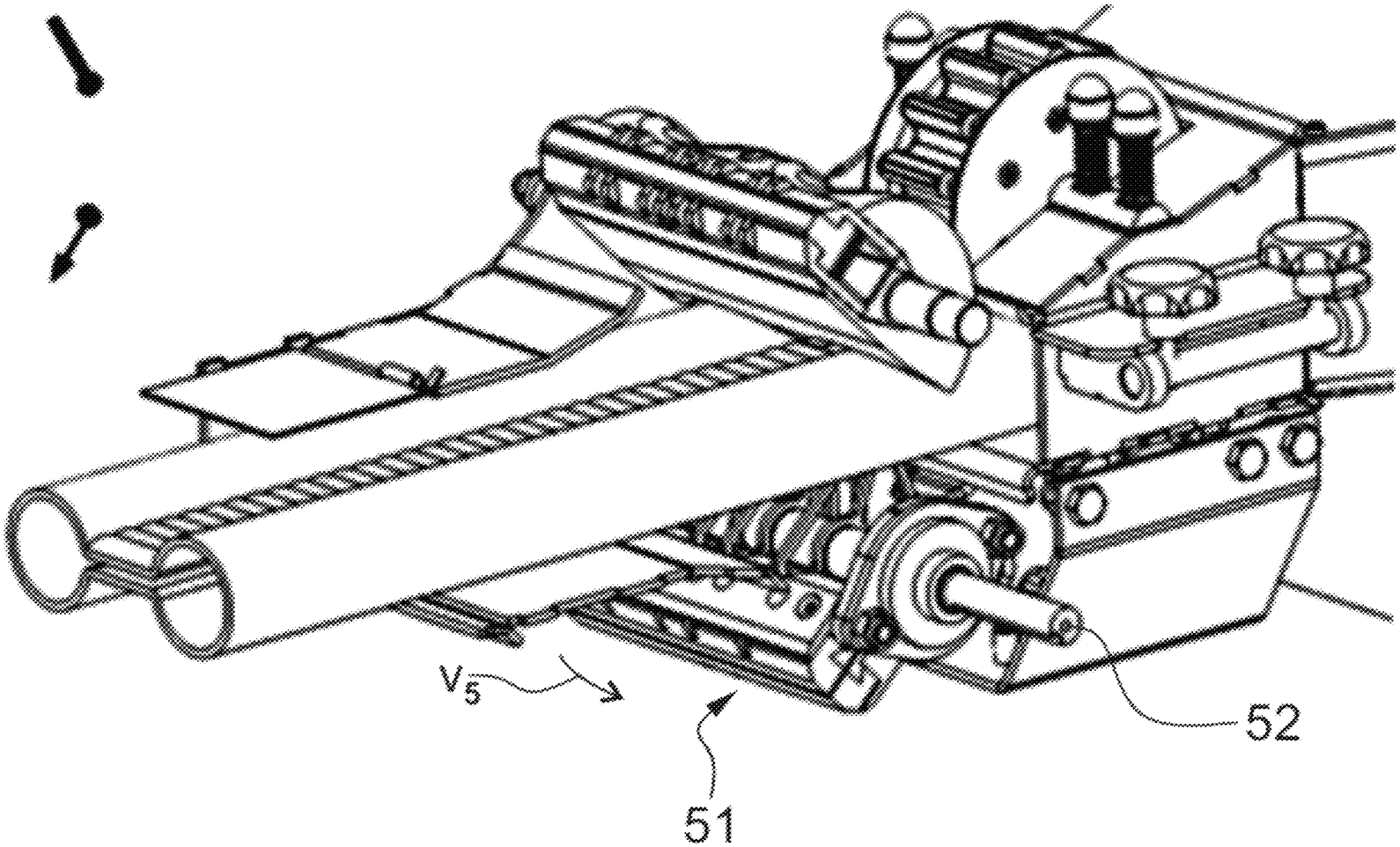
Figure 1C:
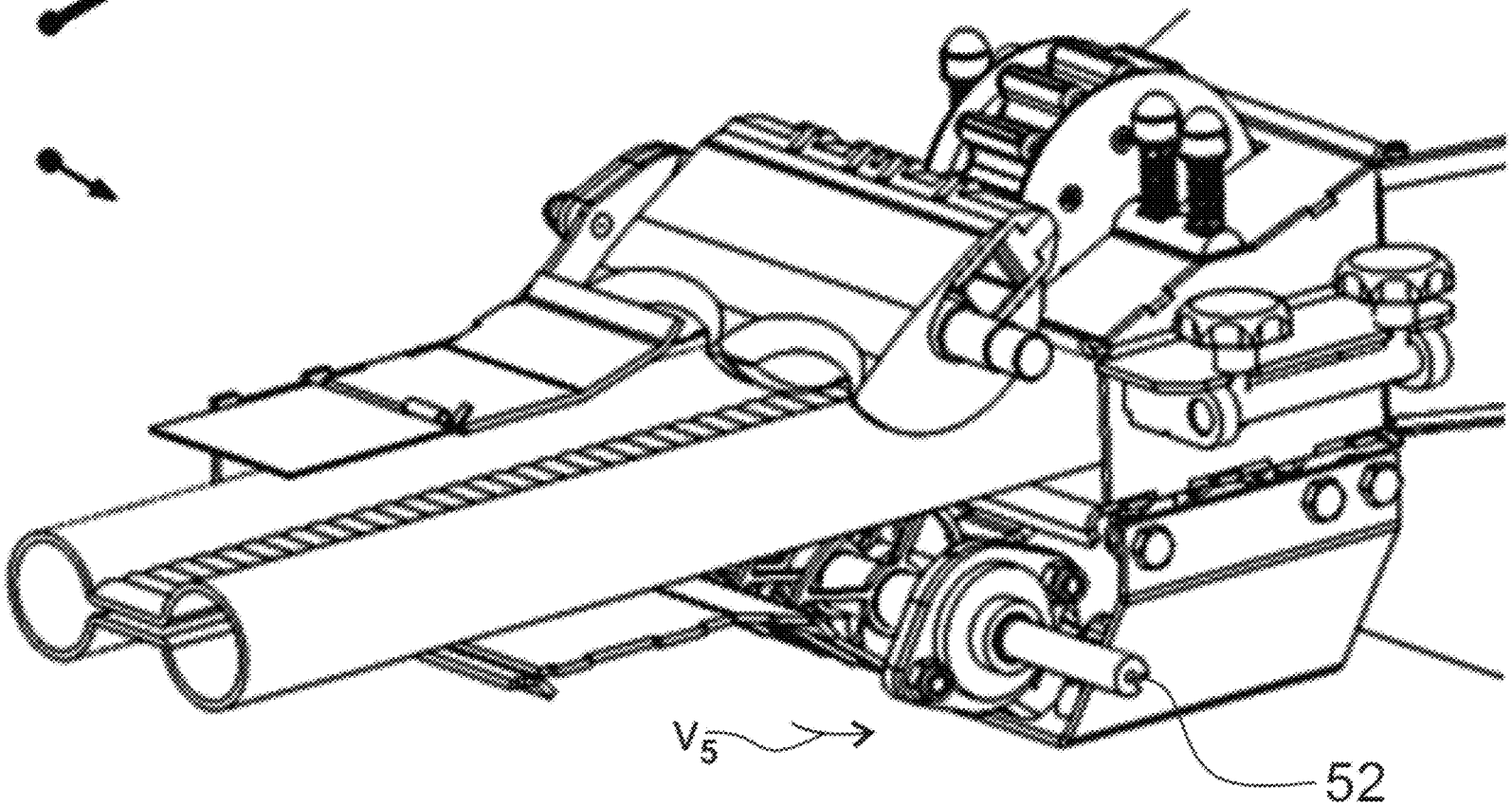
Figure 1D:
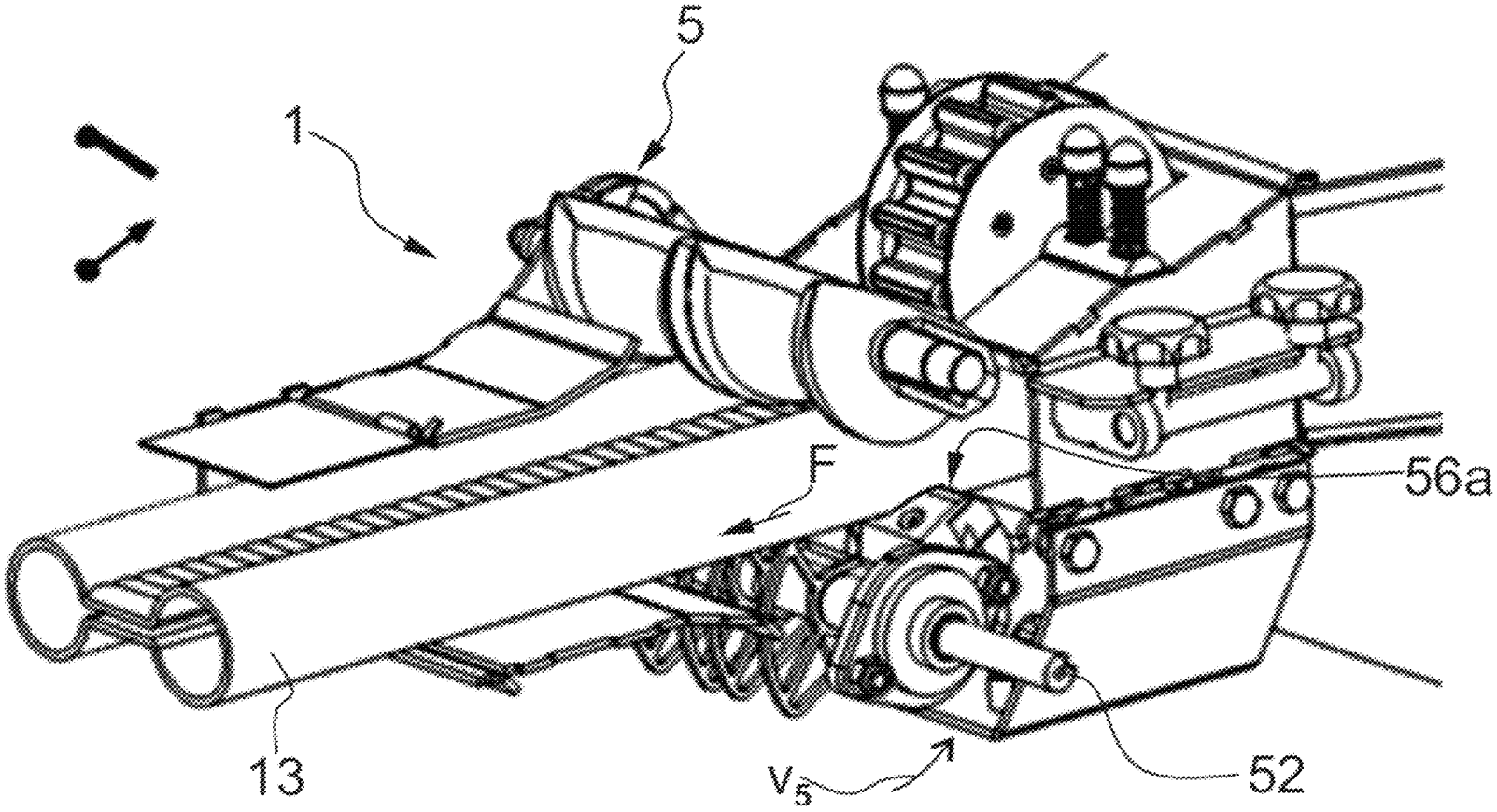
Figure 1E:
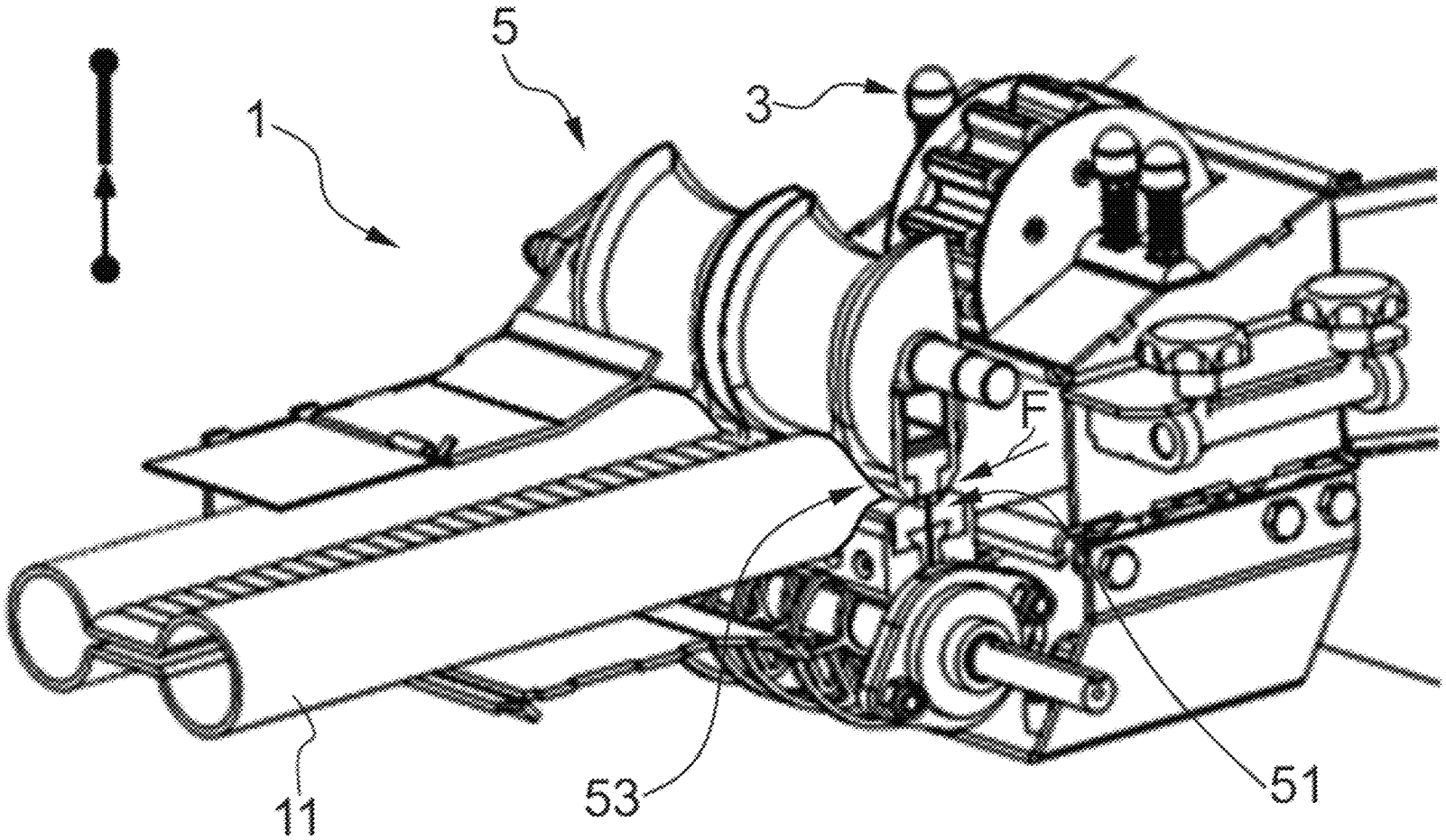

FIGS. 1E and 2E show the cutting unit 5 and the cutting position E. The rotation plate 51 with the cutting pad 53 cuts a cushion product 11 from the paper strip 13 in the cutting position E (FIG. 1E). The rotation blade 51 crosses the feed path F' of the paper strip 13, along which the paper strip 13 is fed at a rate preferably equaling with the target feed rate f, at the moment of the cutting position E.

Starting from the initial position A or initial position, the rotation blade 51 moves around the rotation shaft 52 with the rotation blade circumferential velocity v5, as exemplarily shown for the respective rotation blade intermediate position B, C, D in FIGS. 1B, 1C and 1D. The path of the predefined motion profile of the rotation cutter is shown for the initial position A, the intermediate positions B, C and D and the cutting position E qualitatively in the diagram of FIG. 9. During the movement from the initial position A in the direction of the cutting position E, the rotation blade first experiences an acceleration until the rotation blade 51 reaches a nominal velocity, present during the passing of the intermediate position D. For accelerating the rotation blade 51 from the initial position A, the motor 61 first, for example during passing the initial positions B and C, provides a high torque, which decreases when reaching the nominal velocity.

The cutting unit 5 has an embossing or punch tool, respectively, 56*a*, 56*b*, both, preceding and following the blade 51 relatively to the direction of rotation. As shown in FIG. 1D, the preceding embossing tool 56*a* of the cutting assembly 5 is coming into contact engagement with the paper strip 13 first. The embossing tool 56 effectuates a stabilization of the cushion shape by the feed pad following the cutting (not further described; compare [DE 10 2012 018 867 A1]). From the moment on which the preceding embossing tool 56*a* is in contact with the paper strip 13, a revolution resistance against the rotation cutting movement is present, so that the rotation movement of the rotation blade 51 is decelerated. Along with that, the torque T5 increases rapidly. The torque T5 reaches its maximum when reaching the cutting position E. After passing the cutting position E, the torque T5 drops. The passing of the cutting position E can be captured with the sensor assembly 25 in order to initiate a subsequent deceleration of the rotation blade 51 so that same stops completely when reaching the initial position A again.

Figure 1F:
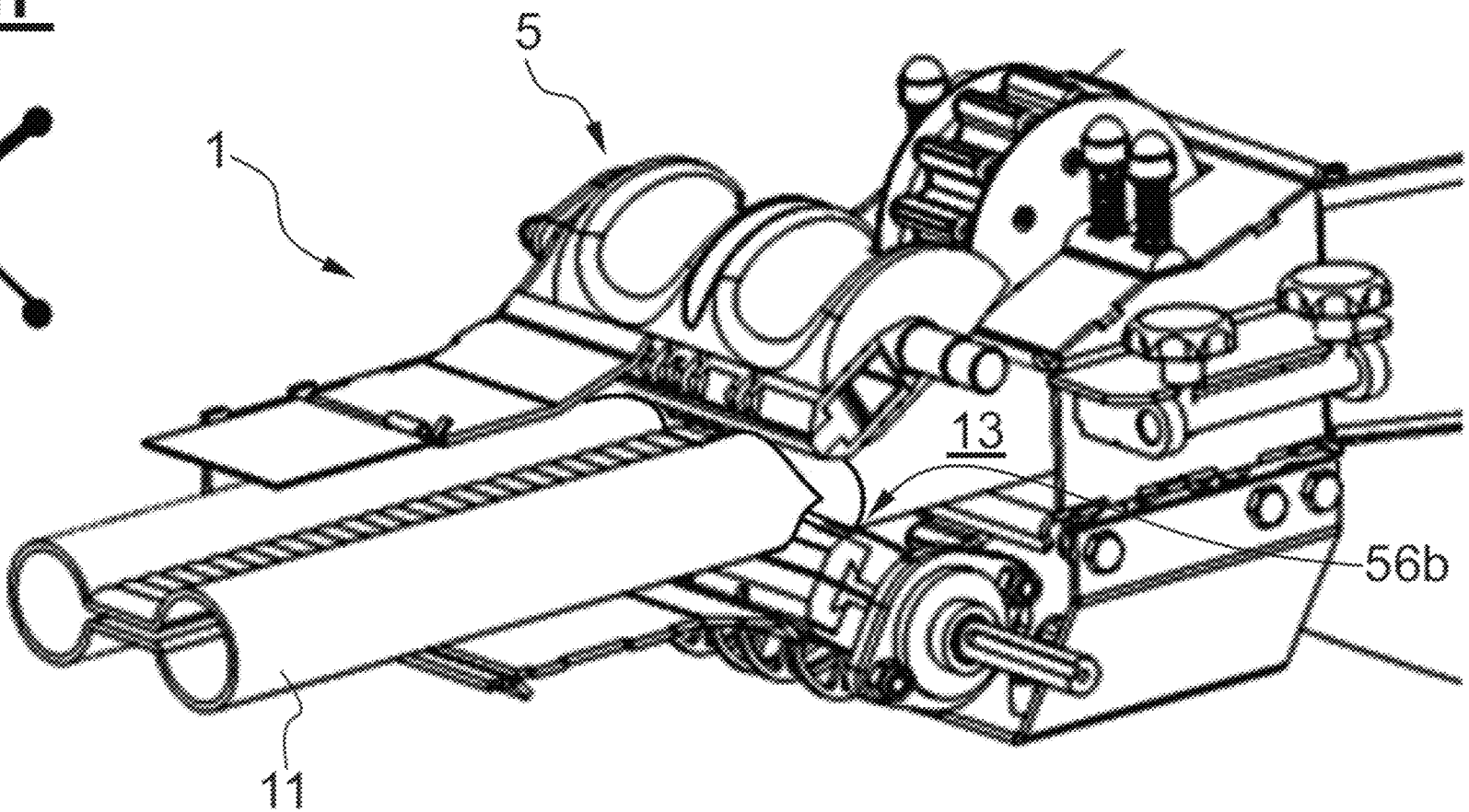

During the cutting of the cushion product 11 from the paper strip 13, the embossing tools 56*a*, 56*b* are executing an embossing at the following end of the cushion product 13 and at the preceding end of the paper strip 13, which becomes a preceding cushion product at the next, following cutting process. In the intermediate position of the cutting unit 5 shown in FIG. 1F, the following embossing tool 56*b* is just in touch contact with the preceding end of the formed paper strip 13.

Figure 8:
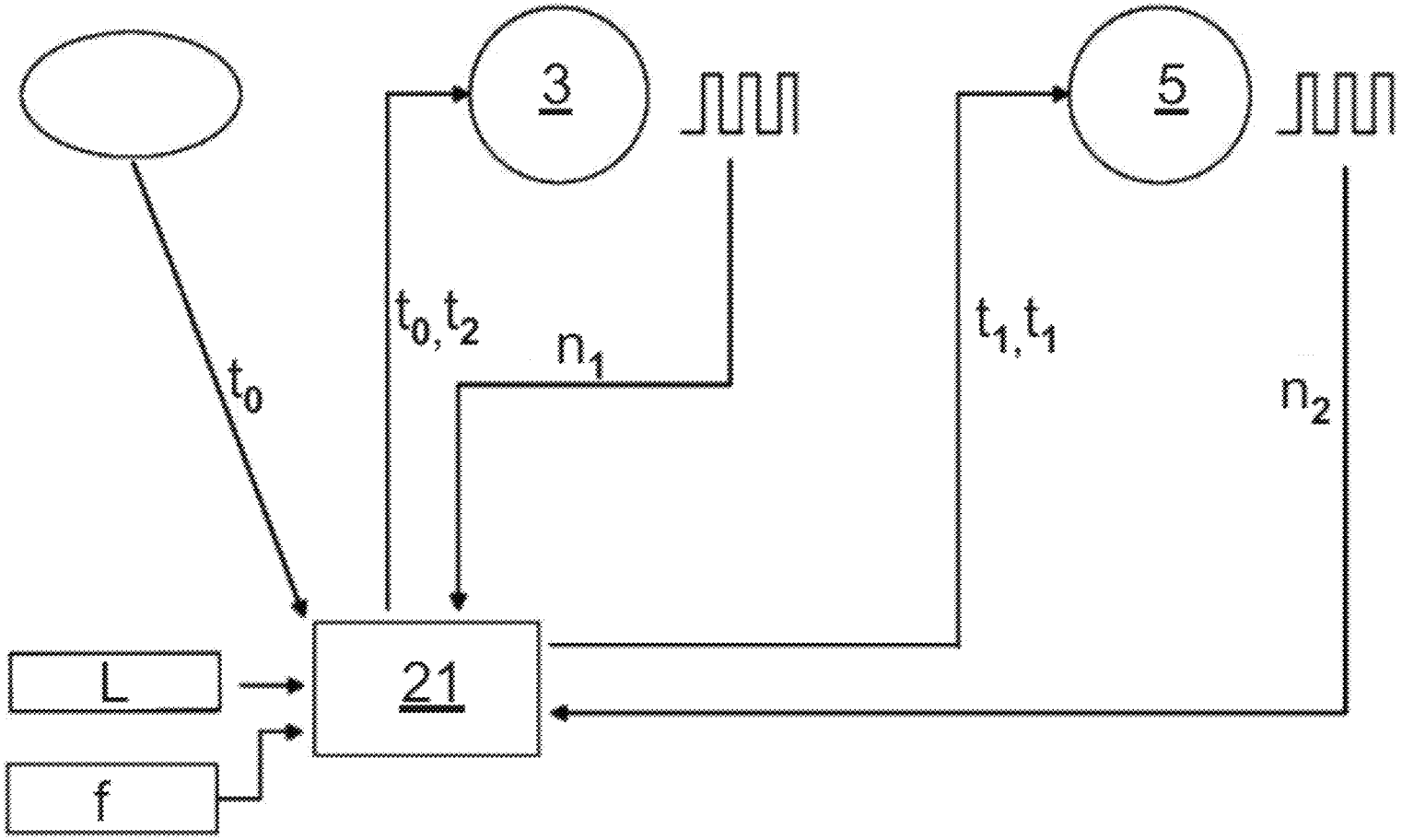
FIG. 8 is a schematic depiction of the production method according to one embodiment.

One embodiment of the production method is shown schematically in FIG. 8. A desired target paper cushion length L and a target feed rate f are predefined to the control electronics 21, for example by a not further depicted user console. The control electronics can have a digital storage for applying one or several cushion length values or feed rate values. When or as long as cushion products are to be produced, the electronic control unit 21 receives an operation signal or start signal T0, respectively. When an initialization signal T0 is present, the control electronics 21 triggers the feed unit 2 to feed the paper strip 13 into the production apparatus. In doing so, the rotation angle opposition of the feed unit 3 is supervised by a sensor 23. The sensor 23 is preferably realized as incremental sensor and comprises impulse-like incremental steps ml. The sensor 23 transmits the rotation angle positions or incremental steps n1, respectively, of the feed unit 3 to the control unit 21. Device-specific variable or constant values, for example regarding the motor 41 or 61, the feed roller 31, 33, for example their feed diameter D3, etc., can be provided in the control unit 21. The control electronics 21 can set and store an incremental threshold value on the basis of the target cushion length L, the target feed rate f, according to which the feed unit 3 is initiated, on whose incidence the cutting unit 4 is triggered to cut off a cushion product 11 approximately corresponding to the target cushion length L.

The control electronics 21 can command one or several predefined motion profiles, particularly on the basis of experience values, preferably relating to device specific specifications. A predefined motion profile can for example be the inertia of the cutting unit 5 taking into account the target pillow length L, the cutting diameter D5, rotation resistances due to embossing tools 56*a*, 56*b*, etc. The motion profile can also take into account the type of material, thickness, number of layers, etc. of the paper strip 13 to be formed, from which the cushion products 11 are cut off. The rotation blade and the rotation tools are preferably provided according to DE 10 2012 018 867 A1, DE 10 2012 018 941 A and/or DE 10 2013 015 875 A1, whose content is included to full extent by reference.

For one time, the cutting unit 5 runs a cyclic motion profile for a cutting process, for example for a single revolution by 360° of the rotation blade 51. The cutting process starts at the moment t1 and ends at the moment t3 at the initial position A. The sensor assembly 25 of the cutting unit 5 can capture the initial position A and/or the cutting position E and/or single incremental steps of the incremental encoder 25*a* and can transmit them as rotation position values n2 of the control electronics 21. Incremental values of the incremental encoder 25*a* and incremental receiver 25*b* of the sensor assembly 25 can be of advantage during the initialization of the production apparatus 1 or when attaining the experience value with regard to one or different predefined motion profiles. According to one embodiment of the apparatus, the sensor assembly 25*b* can be set up to solely capture the initial position A and/or the cutting position E. The rotation angle positions captured by the sensor assembly 25 can be stored in the control electronics 21 in order to generate iteratively improved motion profiles. The rotation position values n of the feed unit with three or the n2 of the cutting unit 5 captured by the control unit can also be used for a device diagnostic.

The attributes disclosed in the preceding description, the figures and the claims can be used in both, separately and in arbitrary combination for the realization of the invention in the different embodiments.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents.

LIST OF REFERENCE NUMERALS

1 Apparatus
2 Frame
3 Feed unit
4 Feed channel
5 Cutting unit
11 Cushion product
13 Paper strip
21 Control electronics
23, 25 Sensor
23*a*, 25*a* Incremental encoder
23*b*, 25*b* Incremental receiver
25*c*, 25*d* Position encoder
31, 33 Embossing rollers
32 Feed roller shaft
35 Side plate
41 Electric motor
43 Transmission gear
51 Rotation blade
52 Cutting shaft
53 Cutting pad
54 Cutting pad shaft
55*a*, 55*b* Teeth wheels
56*a*, 56*b* Punching tool
61 Drive motor
63 Reduction gear
A-F Rotation angle position
$D_3$ Feed diameter
$D_5$ Cutting diameter
F Feed path
f Target feed rate
L Target cushion length
$n_1$ Incremental count threshold value
$p_3$ Feed diameter
$T_0$ Initialization signal
$T_5$ Torque profile
$v_5$ Circumferential speed

I claim:

1. An apparatus for the production of a cushion product from a continuous paper strip, the apparatus comprising:

a feed unit configured for drawing the paper strip into the apparatus;

a cutting unit configured for cutting the cushion product from the paper strip, wherein the cutting unit comprises a rotation blade and a rotation cutting pad, the rotation cutting pad arranged opposing the rotation blade and configured to rotate adaptably to the rotation velocity of the rotation blade; and a control electronics for an activation of the cutting unit according to a predetermined motion profile, the control electronics further comprising a sensor configured for capturing a rotation angle position of the feed unit, wherein the control electronics is configured to activate the feed unit continuously and to start the activation of the cutting unit for a discontinuous cutting operation during the capturing of the predetermined actual rotation angle position of the feed unit.

2. The apparatus according to claim 1, wherein the control electronics is configured to determine a target feed rate for feeding the paper strip and to initialize the feed unit continuously according to the target feed rate, as well as to determine a target cushion length, and to adjust the cutting operation according to the target feed rate and the target cushion length, wherein the control electronics is configured to consider a feed diameter of the feed unit or a cutting diameter of a cutting unit.

3. The apparatus according to claim 2, wherein the control electronics is configured to define the predetermined current rotation angle position for the cutting operation for the production of cushion products in accordance with the target cushion length on the basis of the target feed rate and the feed diameter, wherein the control electronics is configured to:

determine an incremental count threshold value, and in consideration of the feed diameter; and induce an initialization of the cutting unit when the sensor is capturing the incremental count threshold value.

4. The apparatus according to claim 1, wherein the sensor comprises a ferromagnetic incremental encoder and an electromagnetic incremental receiver, wherein the ferromagnetic incremental encoder has an incremental resolution between 20°-100° increments.

5. The apparatus according to claim 1, wherein the control electronics is configured to coordinately trigger the feed unit and a cutting rate of the cutting unit and a circumferential velocity of a rotation blade is 1% to 10% larger than a circumferential velocity of the feed unit.

6. The apparatus according to claim 5, wherein the cutting unit comprises a rotational blade and the control electronics comprises a second sensor assembly for capturing a rotation angle position of the rotation blade, wherein the sensor assembly comprising a second ferromagnetic incremental encoder and a second electromagnetic incremental receiver, wherein the second ferromagnetic incremental encoder has an incremental resolution between 10-100 increments.

7. The apparatus according to claim 6, wherein the sensor assembly is configured to monitor a cutting rotation angle position or a hold point rotation angle position of the rotation blade, with one or two position encoders, wherein the control electronics is configured to initiate a braking procedure for the cutting unit during the monitoring of the cutting rotation angle position.

8. The apparatus according to claim 1, wherein the predetermined motion profile comprises a velocity profile or a torque profile.

9. The apparatus according to claim 1, wherein the paper strip is drawn from a supply roll or supply stack and formed to a three-dimensional fill material strand upstream in a feed direction of the cutting unit.

10. The apparatus according to claim 1, wherein the central area is plastically deformed and the two hollow crumple spaces are formed by folding the edges towards the middle.

11. A method for the production of a cushion product from a continuous paper strip, the method comprising;

feeding the paper strip into the apparatus continuously by a feed unit with a constant feed rate;

cutting of the cushion product from the paper strip according to a predefined motion profile by a cutting unit being operated discontinuously, wherein the cutting unit comprises a rotation blade and a rotation cutting pad, the rotation cutting pad arranged opposing the rotation blade and configured to rotate adaptably to the rotation velocity of the rotation blade;

capturing a rotation angle position of the feed unit; and inducing the discontinuous cutting when reaching a predetermined rotation angle position of the feed unit.

12. The method according to claim 11, wherein the predetermined motion profile comprises:

an acceleration phase, in which a rotation blade of the cutting unit is accelerated to a nominal velocity;

an operation phase in which the rotation blade is moved constantly with nominal velocity, wherein the nominal velocity is 1% to 10% larger than the constant feed rate;

a cutting process, during which the cutting unit separating the cushion product from the paper strip, wherein the cutting rate of the rotation blade is 1% to 10% larger than the constant feed rate;

a braking phase, in which the velocity of the cutting unit is reduced; and a hold phase, in which the rotation blade is held fixedly in an initial position.

13. The method according to claim 11, wherein the predetermined motion profile comprises a velocity profile or a torque profile.

14. The method according to claim 11, wherein the central area is plastically deformed and the two hollow crumple spaces are formed by folding the edges towards the middle.

15. The method according to claim 11, further comprising:

determining a target feed rate for feeding the paper strip;

initializing the feed unit continuously according to the target feed rate;

determining a target cushion length; and to adjusting the cutting operation according to the target feed rate and the target cushion length, wherein the adjusting considers a feed diameter of the feed unit or a cutting diameter of the cutting unit.

16. The method according to claim 15, further comprising:

defining the predetermined current rotation angle position for the cutting operation for the production of cushion products in accordance with the target cushion length on the basis of the target feed rate and the feed diameter by:

determining an incremental count threshold value, and in consideration of the feed diameter; and inducing an initialization of the cutting unit when the incremental count threshold value is captured by a sensor.

17. The method according to claim 16, wherein the sensor comprises a ferromagnetic incremental encoder and an electromagnetic incremental receiver, wherein the ferromagnetic incremental encoder has an incremental resolution between 20°-100° increments.

18. The method according to claim 15, further comprising:

coordinately trigger the feed unit and a cutting rate of the cutting unit and a circumferential velocity of the rotation blade is 1% to 10% larger than a circumferential velocity of the feed unit.

19. An apparatus for the production of a cushion product from a continuous paper strip, the apparatus comprising:

a feed unit configured for drawing the paper strip into the apparatus;

a cutting unit configured for cutting the cushion product from the paper strip; and a control electronics for an activation of the cutting unit according to a predetermined motion profile, the control electronics further comprising a sensor configured for capturing a rotation angle position of the feed unit, wherein the control electronics is configured to activate the feed unit continuously and to start the activation of the cutting unit for a discontinuous cutting operation during the capturing of the predetermined actual rotation angle position of the feed unit, wherein the control electronics is configured to coordinately trigger the feed unit, and a cutting rate of the cutting unit and a circumferential velocity of a rotation blade is 1% to 10% larger than a circumferential velocity of the feed unit.

20. An apparatus for the production of a cushion product from a continuous paper strip, the apparatus comprising:

a feed unit configured for drawing the paper strip into the apparatus;

a cutting unit configured for cutting the cushion product from the paper strip; and a control electronics for an activation of the cutting unit according to a predetermined motion profile, the control electronics further comprising a sensor configured for capturing a rotation angle position of the feed unit, wherein the sensor comprises a ferromagnetic incremental encoder and an electromagnetic incremental receiver, wherein the ferromagnetic incremental encoder has an incremental resolution between 20 and 100 increments/360°;

further wherein the control electronics is configured to activate the feed unit continuously and to start the activation of the cutting unit for a discontinuous cutting operation during the capturing of the predetermined actual rotation angle position of the feed unit.

* * * * *